US005871095A

United States Patent [19]

Warnock et al.

[11] Patent Number: 5,871,095

[45] Date of Patent: Feb. 16, 1999

[54] CONTAINER FOR PROTECTING FRAGILE FOOD PRODUCTS DURING SHIPPING AND DISPLAY

[75] Inventors: Donald G. Warnock, Madera; Karl Torosian, Fresno, both of Calif.

[73] Assignee: Warnock Food Products, Inc, Madera, Calif.

[21] Appl. No.: 628,085

[22] Filed: Apr. 3, 1996

[51] Int. Cl.[6] ..... B65D 65/00

[52] U.S. Cl. ..... 206/434; 206/155; 206/497

[58] Field of Search ..... 206/45.26, 155, 206/432, 434, 461, 497, 736, 756, 764, 770; 229/103.2, 103.3, 109, 186, 190

[56] References Cited

U.S. PATENT DOCUMENTS

| | | | |
|---|---|---|---|
| 2,849,111 | 8/1958 | Fielding | 206/434 |
| 3,337,033 | 8/1967 | Cote . | |
| 3,411,696 | 11/1968 | Ayer et al. . | |
| 3,618,848 | 11/1971 | Pawlowski . | |
| 3,705,681 | 12/1972 | Rossi et al. . | |
| 3,901,382 | 8/1975 | Roccaforte . | |
| 3,963,121 | 6/1976 | Kipp | 206/155 |
| 4,248,901 | 2/1981 | Austin . | |
| 4,299,850 | 11/1981 | Wallen et al. . | |
| 4,381,837 | 5/1983 | Cortopassi . | |
| 4,451,001 | 5/1984 | Webinger . | |
| 4,498,618 | 2/1985 | Sutherland | 206/155 |
| 5,128,157 | 7/1992 | Ruiz . | |
| 5,326,577 | 7/1994 | Warnock . | |
| 5,472,092 | 12/1995 | Evert | 206/497 |
| 5,560,539 | 10/1996 | Baxter | 229/109 |

FOREIGN PATENT DOCUMENTS

| | | | |
|---|---|---|---|
| 298780 | 1/1989 | European Pat. Off. | 206/434 |

*Primary Examiner*—David T. Fidel
*Attorney, Agent, or Firm*—Joseph C. Andras

[57] ABSTRACT

A container for protecting a fragile food product during transport and display is constructed from sheet material such as paperboard or the like. The container is formed by folding the sheet material into an open-ended box sized to accommodate the fragile food product inside. End flaps extending from the sides of said box are folded angularly inward and preferably lock in an inwardly folded position to secure the fragile food product inside the container. A retention band is preferably placed around the container and cinched by heat shrink or other method to further secure the end flaps in their inwardly folded position and reduce the movement of the fragile food product therein. Foot tabs are preferably included on the bottom of the container to allow the container to be shipped or displayed upright on a flat surface while maintaining clearance between the fragile food product and the flat surface.

13 Claims, 3 Drawing Sheets

CONTAINER FOR PROTECTING FRAGILE FOOD PRODUCTS DURING SHIPPING AND DISPLAY

BACKGROUND OF THE INVENTION

1. Field of the Invention

This invention relates to a container used in the storage, shipping, and displaying of fragile food products such as edible salad bowls and the like.

2. Description of Related Art

There is a wealth of related art in the field which attempt to provide a suitable container for transporting and displaying a fragile food item such as edible salad bowls and the like. Ideally a container should protect the item from breakage during shipping while economizing space, and provide an attractive container to catch the consumers' attention. Additionally, it is preferred that at least part of the container be transparent so that a visual inspection of the contents of the container may be made. See for example, the inventions of Webinger, U.S. Pat. No. 4,451,001; Wallen, U.S. Pat. No. 4,299,850; and Warnock, U.S. Pat. No. 5,326,577. The related art typically suffer from one of two problems: either they lack the characteristic of providing visual inspection of the product, which is important to purchasers of fragile food products, or they lack sufficient sturdiness to protect the fragile food product from breakage. Therefore, it is an object of the present invention to provide a sturdy container for fragile food products such as edible salad bowls, tostada shells, and the like, which can be used for shipping and display purposes. It is another object of the current invention to provide a consumer with the ability to visually inspect the fragile food product within the container. Finally, it is an object of the present invention to minimize breakage of the fragile food product during shipping and display by providing extra clearance between the fragile food product and the surface upon which the container is rested, even if shipping or other activity causes the fragile food product to settle.

OBJECTS AND SUMMARY OF THE INVENTION

The present invention is directed to a container for protecting a fragile food product during shipping and display which provides sufficient protection to minimize breakage while permitting a consumer to visually inspect said fragile food product within said container. The container comprises an open-ended box having front and rear walls and side walls which together form the protective structure for the fragile food product. The fragile food product is inserted into the structure through one of the end openings defined by the edges of the front and rear walls and side walls. The fragile food product is thereafter secured in the structure by folding end flaps that extend from the side walls angularly inward to partially enclose the structure about the fragile food product. Each end flap is preferably connected to the front and rear wall by first and second tuck panels, respectively, which, when the end flaps are in the angularly inward folded position, help lock the end flaps is said position. The two tuck panels associated with each end flap (the first connecting the front wall and the second connecting the rear wall) are formed from the corners of the front and rear wall respectively using perforated score lines. The fragile food product is beneficially secured within the structure while remaining visible in the gap between the two end flaps. Foot tabs are preferably provided along the lower edge of the front and rear wall to extend the entire container upwards an incremental distance to prevent the contacting of the fragile food product with a supporting surface, which may damage the fragile food product. The incremental distance is defined by the height of the foot tabs. The foot tabs maintain sufficient clearance between the fragile food product and a supporting surface to prevent unwanted contact.

Although the tuck panels lock the end flaps in the angularly inward folded position, the present invention preferably uses a retention band to further secure the flaps in the angularly inward folded position. The retention band also tends to straighten the front and rear walls of the container by pulling the tuck flaps inward as the band is tightened around the container, which causes the connected edges of the front and rear walls to be pulled toward one another. The front and rear walls have a tendency to bow outward when the end flaps are folded inward as the connected tuck panels push against the adjoining edge of the wall, causing the ends of the walls to bend apart, i.e., outwardly. When the retention band is tightened around the end flaps, the tension on the tuck panels pulls the connecting front or rear wall toward the direction of the tension, that is, inwardly. Alternatively, an overwrap can be placed over the entire container to seal the contents of the container and to reinforce the integrity of the container.

The retention band or the overwrap are preferably a heat shrink material which can be placed on the package and then subjected to heat to shrink the band or overwrap into its retention position, but the retention band can also be a tape or another mode of securing the band about the container. The retention band or the overwrap may be transparent, which has the advantage of allowing the viewing of the fragile food product inside the container, or they may have artwork printed thereon.

When a fragile food product such as a stack of edible salad bowls are placed in the container, the reaches of the fragile food products may protrude from the interior of the container. This is caused by the fact that the fragile food products are not uniformly shaped and individual food items may not fit entirely within the package. However, if the fragile food product contacts anything other than the container, it may break or crumble or become otherwise damaged. To prevent the fragile food product from contacting any other surface, including package inserts and other fragile food products when said product is shipped together in closely packed shipping containers, the front and rear walls are shaped so that their upper and lower edges extend beyond the farthest reach of a fragile food product. With the upper and lower edges extended beyond the reaches of the fragile food product, the front and rear walls shield the fragile food product, and the fragile food product is prevented from contacting any surfaces regardless of which edge the container is set upon.

To further protect the fragile food product, foot tabs are placed on the lower edges of the front and rear walls. Aside from the foot tabs, the preferred container is horizontally and vertically symmetric. The upright orientation of the container is readily apparent, however, because of the text and artwork on the container. The foot tabs provide extra clearance between the lower reaches of the fragile food product, which tend to protrude from between the angularly extended end flaps, and the supporting surface by raising the container incrementally upward as the container stands on the foot tabs. This clearance may become necessary due to settling of the fragile food product during shipping and handling as well as the natural tendency of gravity to shift the product downwards.

The foot tabs also provide additional protection against the contacting of the fragile food product with the supporting surface due to the bending or degradation of the lower edge as a result of continuous or jarring contact with the supporting surface. As with any lightweight or thin edge, the result of repeated or continuous contact with the supporting surface may cause the edge to curl, bend, or fray. This degradation of the lower edge reduces the clearance between the fragile food product and the supporting surface and increases the likelihood of unwanted contact between them. Hence, the foot tabs provide additional clearance for said container to reduce the opportunity for the fragile food product to contact the supporting surface.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in with the accompanying drawings.

DETAILED DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to a container for protecting fragile food products 13. The food product 13 is preferably overwrapped with a heat shrink film 15 before insertion into the container 99 to seal the food product 13 and form a unitary, sanitary package.

Figure 1:
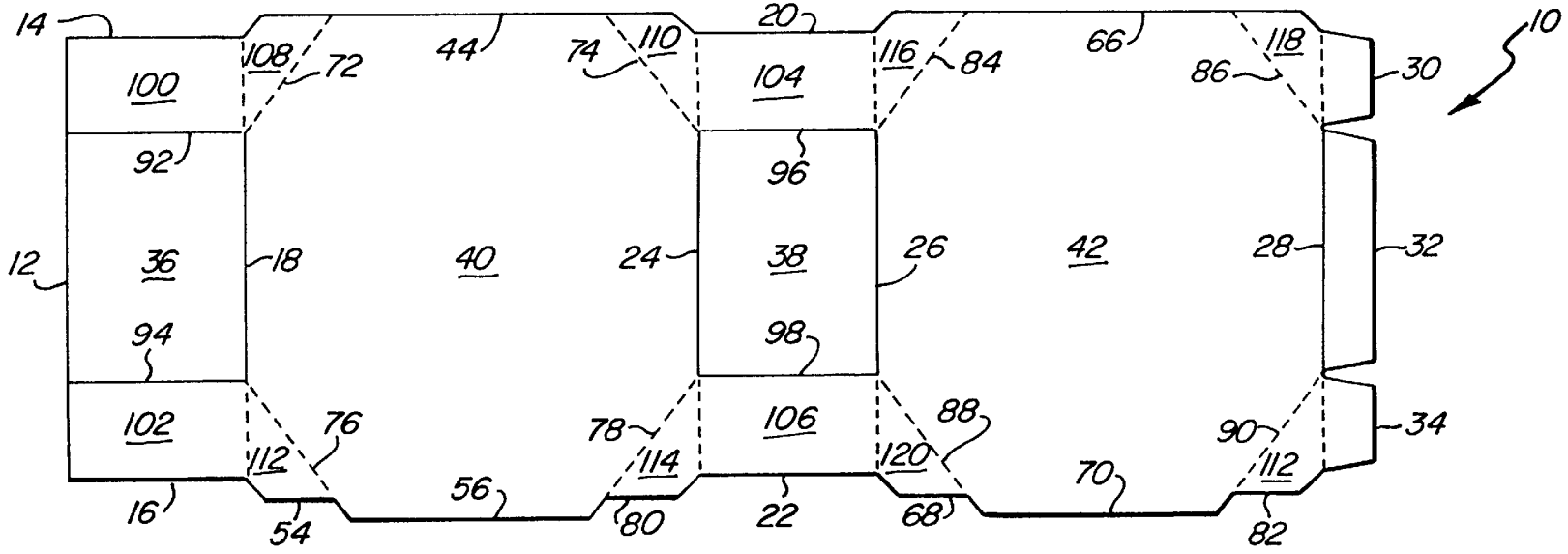
FIG. 1 is a plan view of a cut and scored blank of sheet material for forming a preferred container according to the present invention.
Figure 3:
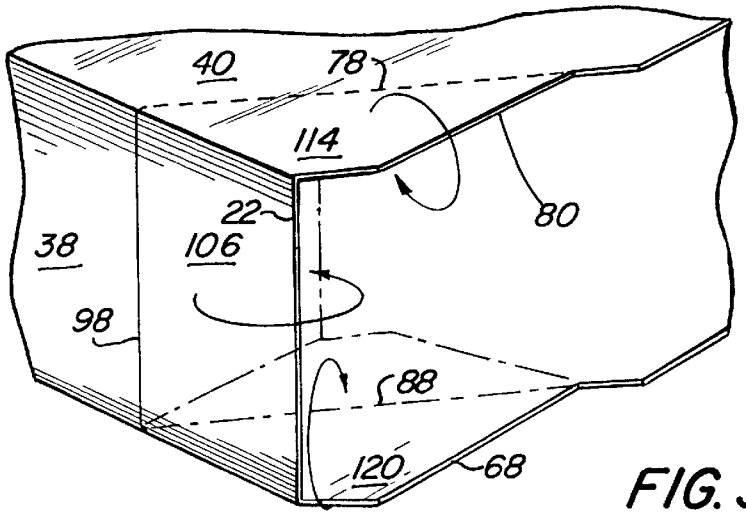
FIG. 3 is a diagonal elevational view of the preferred container demonstrating the action of the end flaps as they are folded into the angularly inward position.

Referring to the drawings, there is shown in FIG. 1 a preferred embodiment of a cut and scored blank which is used to construct the present invention. The blank, denoted generally 10, is preferably paperboard or other suitable material which is lightweight and may be folded easily. The blank includes a first side wall 36 defined by edges 12, 14, 16, and by a fold line 18, and a second side wall 38 defined by edges 20, 22 and fold lines 24, 26. The side walls are of equal length and height and are generally parallel in the assembled configuration. The side wall 36 has fold lines 92 and 94 extending from edge 12 to fold line 18, and the side wall 38 has fold lines 96 and 98 extending from fold line 24 to fold line 26. A container is formed by folding the fold lines 18, 24, 26, and 28 into right angles such that the edge 12 contacts the fold line 28 with the protruding tabs 30, 32, 34 flush against the side wall 36. The structure is fixed in said position by affixing said protruding tabs 30, 32, and 34 to the side wall 36 with any commercially viable adhesive to yield the open-ended box 11 of FIG. 2.

The front wall 40 and the rear wall 42 are connected by the side walls 36 and 38. The front wall 40 is defined by two fold lines 18, 24, a top edge 44, two bottom edges 54, 80, and a foot tab 56. The rear wall 42 is defined by two fold lines 26 and 28, a top edge 66, two bottom edges 68, 82, and a foot tab 70. The front wall contains a perforated a score line 72 extending from the top edge 44 to the fold line 18, a perforated score line 74 extending from the top edge 44 to the fold line 24, a perforated score line 76 extending from the bottom edge 54 at the foot tab 56 to the fold line 18, and a perforated score line 78 extending from the bottom edge 80 at foot tab 56 to fold line 24. The rear wall 42 contains a perforated score line 84 extending from the top edge 66 to the fold line 26, a perforated score line 86 extending from the top edge 66 to the fold line 28, a perforated score line 88 extending from the bottom edge 68 at the foot tab 70 to the fold line 26, and a perforated score line 90 extending from the bottom edge 82 at the foot tab 70 to the fold line 28.

Figure 2:
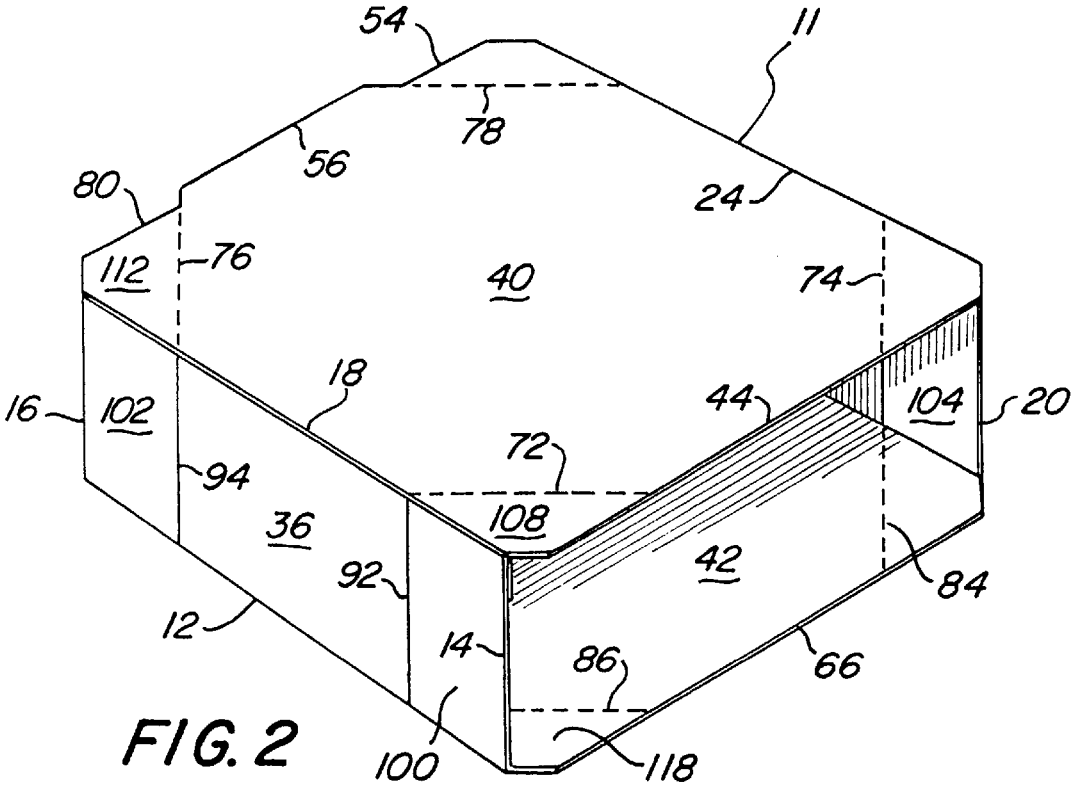
FIG. 2 is a diagonal elevational view of the preferred container in the open box configuration.
Figure 4:
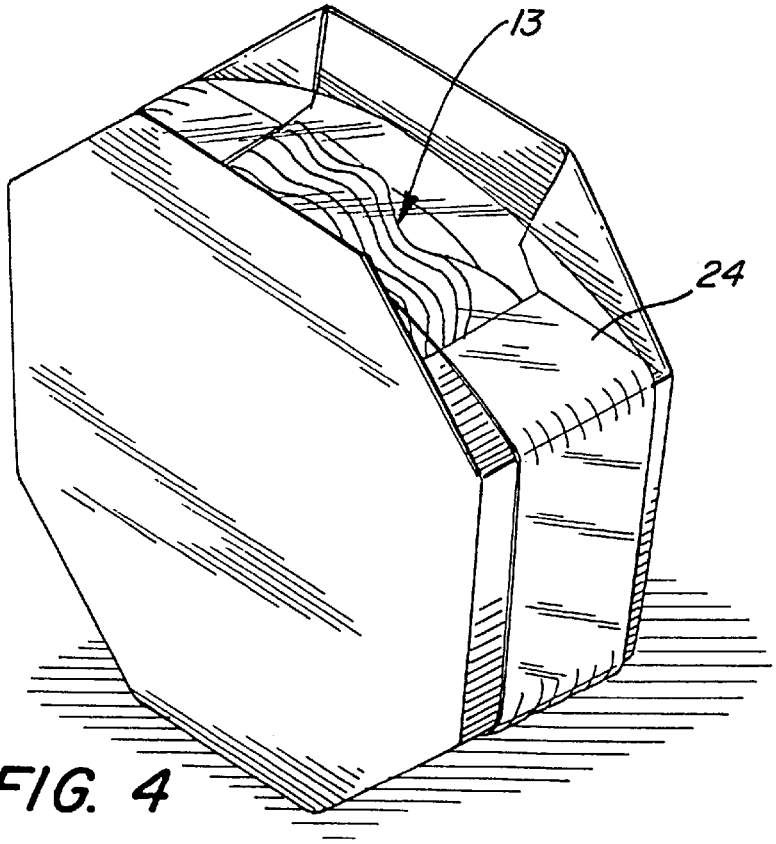
FIG. 4 is a diagonal elevational view of the preferred container on its foot tabs with the end flaps locked in the angularly inward folded position and a retention band in place.

The end flap 100 is defined by a side wall folding line 92, an edge 12, a top edge 14, and a folding line 18. The end flap 102 is defined by a side wall folding line 94, an edge 12, a bottom edge 16, and a folding line 18. The end flap 104 is defined by a folding line 24, an edge 20, a folding line 26, and a side wall folding line 96. The end flap 106 is defined by a side wall folding line 98, a folding line 24, a bottom edge 22, and a folding line 26. When the protruding tabs 30, 32, and 34 are affixed to the side wall 12, the structure resembles an open box as depicted in FIG. 2. The structure can now receive the fragile food product in the volume formed by the open box, said fragile food product generally centered therein. Once the fragile food product is disposed in the container, end flaps 100 and 104 are folded inward towards each other along the fold lines 92, 96 with an exposed product area located between the edges of the end flaps; (see generally FIGS. 2 and 4). The folding of the end flap 100 causes the tuck panels 108, 118 to fold inwardly against the front wall 40 and rear wall 42, respectively, thereby biasing end flap 100 in its inwardly folded position. Similarly, the folding of the end flap 102 causes the tuck panels 112, 122 to fold inwardly against the front wall 40 and rear wall 42, respectively, thereby biasing the end flap 102 in its inwardly folded position. In the same manner, the folding of the remaining end flaps 104, 106 cause the respective tuck panels 110, 116, 114, 120 to fold inwardly against the front and rear walls 40, 42, thereby biasing the respective end flaps 104, 106 in their inwardly folded position.

The presence of the tuck flaps and their natural tendency to unfold from their folded position cause the two top edges 44, 66 to separate, especially as time goes by. Similarly, the bottom edges 54, 80 and the included foot tab 56 tend to separate from the opposed bottom edges 68, 82 and included foot tab 70. This separation causes the front wall 40 and the rear wall 42 to take on a convex shape in relation to each other, which is generally disfavored because is creates irregular stacking configurations and reduces the clearance between the reaches of the fragile food product enclosed in the structure and any contacting surface. To alleviate the problem and secure the end flaps 100, 102, 104, 106 in their inwardly folded position until such time as the fragile food products are ready to be removed, a retention band 124 is provided. The retention band 124 circumscribes the container along a path defined by end flap 100, side wall 36, end flaps 102, 106, side wall 38, and end flaps 104, 100 (see FIG. 4). In the preferred embodiment, the retention band 124 is made of a heat shrink wrap material such that when a loose fitting band of heat shrink material is placed around the path described above and subjected to heat, the band reduces in size thereby constricting the end flaps so contacted. With the pressure applied to the end flaps 100, 102, 104, 106 from the retention band 124, the tuck panels are pulled inwardly at the edge common to the tuck panel and the front or rear wall. For example, the inward pressure from the retention band 124 on the end flap 104 causes the adjacent tuck panels 110, 116 to be pulled inward by their common edges 24 and 26 respectively. The tension on the tuck panel 110 causes the front wall 40 to be pulled inward along the perforated score line 74, and tension on the tuck panel 116 causes the rear wall 42 to be pulled inward along the perforated score line 84. This resulting tension helps reduce the undesirable concave shape of the front and rear walls 40, 42.

Figure 5:
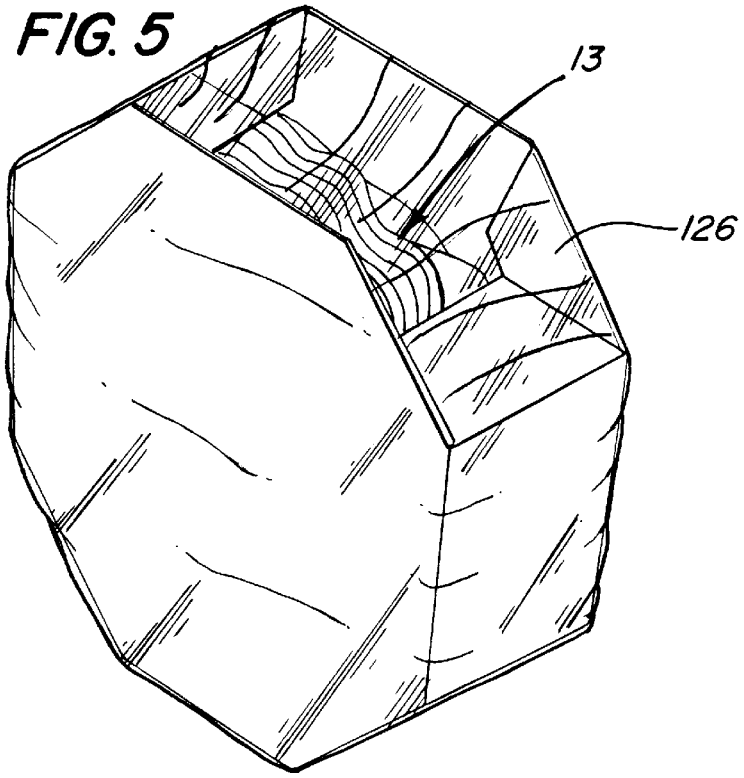
FIG. 5 is a diagonal elevational view of the preferred container on its foot tabs with an overwrap (shown loosely only for clarity) in lieu of a retention band.

In an alternative embodiment, the entire container may be enclosed in a protective overwrap 126 to secure the containers' shape and to seal, or further seal, the contents of the container. In FIG. 5, a container is shown with the overwrap 126 in place. The overwrap 126 helps to maintain the desired shape of the container by constricting the container's front and rear surfaces, which in turn bias the tuck panels and end flaps in the proper position.

With the end flaps folded in the inwardly folded, the front and rear panels are octagonal. This shape is desirable because it approximates the contour of a round fragile food product such as an edible salad bowl, thereby saving materials, while providing flat edges for stability and easy stacking. The dimensions of the container are set by the size of the enclosed fragile food product. The exposed product area between the edge 20 on the end flap 104 and the edge 14 on end flap 100 when said end flaps are in the inwardly folded position should be less that the width of the fragile food product 13 to prevent it from passing between the two end flaps. The same situation exists for the edges 22, 16 on the end flaps 106, 102. Furthermore, in the preferred embodiment, the two top edges 44, 66 should extend beyond the reach of the fragile food product 13, as should the foot tabs 56, 70 to protect the fragile food product 13 should settling occur during shipping or handling.

Figure 6:
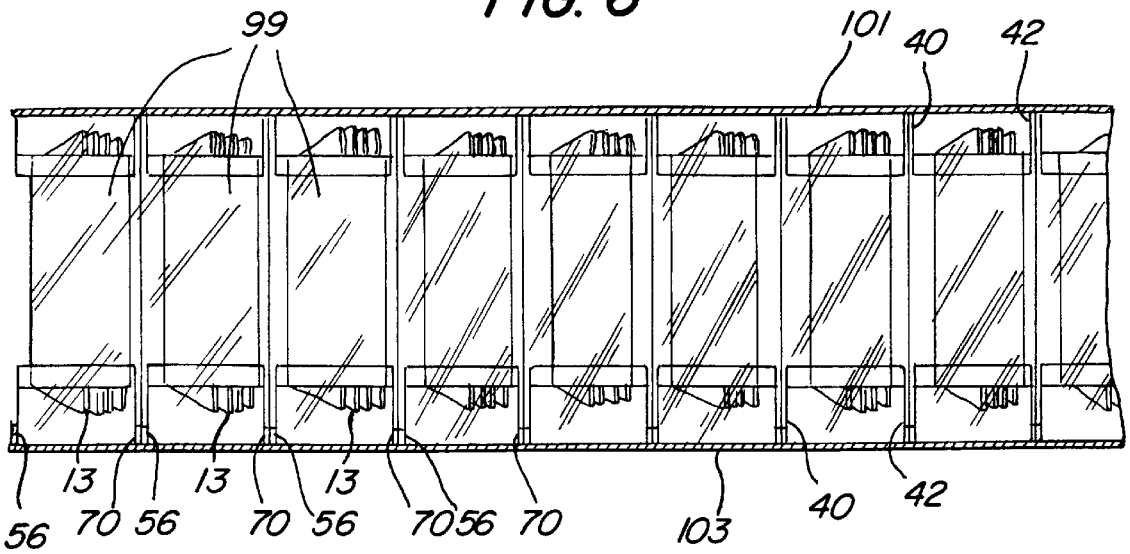
FIG. 6 is a side view of a typical packaging group of containers of the present invention.

As illustrated in FIG. 6, containers 99 which are stored together in a shipping box 101 may settle or move due to shock, vibration, and agitation during shipping. The upper wall and lower edges extend above and below the food product 13 to provide protection from such movement. The presence of the foot tabs 56, 70 further reduce the likelihood that the fragile food product 13 will contact a lower supporting surface 103 within the shipping box 101, and even later, while on display.

Those skilled in the art will appreciate that various adaptations and modifications of the just-described preferred embodiment can be configured without departing from the scope and spirit of the invention. Since many changes and variations of the disclosed embodiment of the invention may be made without departing from the inventive concept, it is not intended to limit the invention otherwise than as required by the appended claims.

What is claimed is:

1. A container for protecting a fragile food product during transport and display comprising:

a rectangular cylinder having first and second open ends for receiving a fragile food product therein and defined by a front wall, a rear wall, and first and second side walls connecting said front and rear walls;

first and second end flaps connected between the front and near walls to said first and second side walls respectively at said first open end of said rectangular cylinder;

third and fourth end flaps connected between the front and rear walls to said first and second side walls respectively at said second open end of said rectangular cylinder;

the first, second, third, and fourth end flaps extending angularly inward from said first and second side wall; and means for securing the first, second, third, and fourth end flaps against an otherwise exposed portion of the fragile food product and for defining exposed product areas at the first and second open ends having a width that is less than a width of the fragile food product in order to secure the fragile food product in said rectangular container, the front and rear walls having edges that extend beyond said inwardly extending end flaps to entirely dispose the fragile food product therebetween.

2. The container as recited in claim 1 wherein said front and rear walls each include a bottom edge, said container further comprising first and second foot tabs centered on the bottom edge of said front and rear walls to stand the container on a flat supporting surface and maintain a clearance between the fragile food product and the flat surface.

3. The container as recited in claim 2 wherein said front and rear walls comprise a plurality of foot tabs on said bottom edges, respectively.

4. The container as recited in claim 1 wherein the means for securing the first, second, third, and fourth end flaps against the fragile food product comprises a retention band circumscribing the container about a path including the inwardly folded flaps, the first and second walls, and the exposed food product areas, said retention band biasing each said end flap in their inwardly extended position and securing the exposed food product areas.

5. The container as recited in claim 1 further comprising a protective overwrap covering the entire container, said protective overwrap biasing the edges of said front and rear walls in a generally parallel configuration.

6. The container as recited in claim 5 wherein the protective overwrap is a heat shrink film.

7. A container for protecting a fragile food product during transport and display comprising:

an open-ended box defined by a front wall and a rear wall each having a pair of opposed folded edges and a pair of opposed open edges respectively, and first and second side walls connecting said front wall to said rear wall at said folded edges, said side walls having a length less than the length of said front and rear walls, said side walls further comprising first and second ends;

an end flap extending angularly inwardly from the first and second end of each of said side walls;

first, second, third, and fourth nonintersecting perforated score lines on each of said front and rear walls, said perforated score lines extending from one of the folded edges to a nearmost open edge, each perforated score line connecting a pair of edges, said first, second, third, and fourth perforated score lines of said front wall being generally parallel to said first, second, third, and fourth perforated score lines of said rear wall;

first, second, third, and fourth pairs of tuck panels connecting each of said end flaps to said front and rear wall respectively, said tuck panels defined by one perforated score line and the adjacent folded and open edges, each of said pairs of tuck panels folding angularly inward along said perforated score line to each lock one connected end flap in said inwardly extended position; and a retention band circumscribing said rectangular cylinder along a path defined by said first and second side walls and said inwardly extended end flaps, said retention band contacting said side walls and said inwardly extending end flaps to bias said end flaps in said inwardly extended position, wherein said front and rear walls extend beyond all said inwardly extending end flaps to entirely dispose said fragile food product therebetween; and wherein said front and rear walls each include an upper and lower edge, said front and rear walls each further comprising a foot tab on said bottom edge to support said container upon a flat surface, said foot tabs maintaining a clearance between said fragile food product and said flat surface in the event that settling shifts said fragile food product within said container.

8. A container as recited in claim 7 wherein said retention band is comprised of an elastic band.

9. A container as recited in claim 7 wherein said retention band is comprised of heat shrink plastic.

10. A container as recited in claim 9 wherein said heat shrink plastic is transparent to permit visual inspection of the fragile food product when same is disposed inside said container.

11. A container as recited in claim 8 wherein said heat shrink plastic has artwork on it.

12. The container as recited in claim 1 wherein the means for securing the first, second, third, and fourth end flaps against the fragile food product comprises a plurality of tuck panels, one pair of tuck panels corresponding to each end flap, each tuck panel joining an edge of a corresponding end flap to an adjacent front or rear wall.

13. The container as recited in claim 1 wherein the means for securing the first, second, third, and fourth end flaps against the fragile food product further comprises a retention band circumscribing the container about a path including the inwardly folded flaps, the first and second side walls, and the exposed food product areas, said retention band biasing each said end flap in their inwardly extended position, securing the exposed food product areas, and biasing the edges of the front and rear walls inward via the plurality of tuck panels to prevent the edges of the front and rear walls from bowing outward.

* * * * *